United States Patent [19]

Sorgenfrei et al.

[11] B 4,001,133

[45] Jan. 4, 1977

[54] METHOD OF WASHING GLASSWARE AND INHIBITED CLEANING SOLUTION AND ADDITIVE COMPOSITION USEFUL THEREIN

[75] Inventors: Malachi E. Sorgenfrei, Grosse Ile; Otto T. Aepli, Southgate, both of Mich.

[73] Assignee: BASF Wyandotte Corporation, Wyandotte, Mich.

[22] Filed: Nov. 4, 1974

[21] Appl. No.: 520,546

[44] Published under the second Trial Voluntary Protest Program on March 2, 1976 as document No. B 520,546.

[52] U.S. Cl. ..... 252/156; 252/526; 252/545

[51] Int. Cl.[2] ..... C11D 7/06; C11D 3/30

[58] Field of Search ..... 252/156, 89, 135, 526, 252/545; 427/165, 168, 169, 314; 65/60

[56] References Cited

UNITED STATES PATENTS

| | | | |
|---|---|---|---|
| 2,419,805 | 4/1947 | Wegst et al. | 252/156 |
| 2,447,297 | 8/1948 | Wegst et al. | 252/135 |
| 3,705,856 | 12/1972 | Sedliar et al | 252/156 |
| 3,743,491 | 7/1973 | Poole et al. | 65/30 E |

*Primary Examiner*—Mayer Weinblatt
*Assistant Examiner*—R. Eugene Varndell, Jr.
*Attorney, Agent, or Firm*—Bernhard R. Swick; L. S. Van Landingham, Jr.; Robert E. Dunn

[57] ABSTRACT

Soiled hot end coated glassware having a substantially colorless and transparent thin protective coating thereon including an organic coating material is washed in an inhibited aqueous caustic soda cleaning solution to inhibit the deleterious effects of repeated washings and thereby increase the effective life of the protective coating. The cleaning solution comprises on a weight basis from 0.3 percent to 6 percent of caustic soda, from 0.01 percent to 0.3 percent of at least one soluble zinc containing compound when calculated as zinc oxide, and the remainder water. Other ingredients which may be present include from 0.002 percent to 0.05 percent of a synthetic organic phosphate ester anionic surfactant having hydrotrophic properties, from 0.001 percent to 0.03 percent of a low foaming synthetic alkoxylated nonionic surfactant, and from 0.008 percent to 0.2 percent of a hard water conditioning sequesterant. The protective coating preferably comprises polyethylene, and for best results a metal oxide layer is applied to the surface of the glassware while hot and a layer of the organic coating material is applied thereover and bonded thereto. A novel inhibited caustic soda cleaning solution having the above composition is provided, and also a liquid additive composition which is useful in preparing the cleaning solution and maintaining the ingredients thereof at proper concentrations. The desirable properties of the hot end coated glassware such as improved lubricity and increased strength are preserved and unsightly discoloration is prevented.

9 Claims, No Drawings

METHOD OF WASHING GLASSWARE AND INHIBITED CLEANING SOLUTION AND ADDITIVE COMPOSITION USEFUL THEREIN

THE BACKGROUND OF THE INVENTION

1. The Field of the Invention

The present invention broadly relates to the washing of glassware in aqueous strongly alkaline solutions. In one of its more specific variants, the invention is concerned with a method of washing soiled hot end coated glassware in an inhibited aqueous caustic soda cleaning solution whereby the resulting cleaned glassware may be recycled. The invention further relates to a novel aqueous caustic soda cleaning solution and an additive composition which is especially useful in preparing and maintaining the same.

2. The Prior Art

A variety of foods and beverages such as milk, soft drinks and beer are packaged in returnable glass bottles which are refilled and recycled a number of times during their normal life. When returnable bottles are emptied by the consumer and returned to the bottler for refilling, they must be washed thoroughly to remove all soil or other residues and thereby render the bottles physically clean. It is also necessary to sterilize the bottles and remove all microbial contamination. The most suitable washing solutions in use at the present time are highly alkaline aqueous solutions of alkali metal hydroxide. Sodium hydroxide is usually lower in cost and is preferred. Other ingredients which may be present include alkali metal carbonates, orthophosphates, pyrophosphates, polyphosphates, silicates, and borates, and various surface active agents.

The surface of glassware which is washed repeatedly in the above described solutions is subject to alkali attack. This is especially pronounced in instances where returnable bottles are washed in a mechanical soaker-washer machine and contacted therein with a heated washing solution over a number of cycles. As a result, the defaced glass surfaces take on a scratched, etched or worn appearance which is often initiated by mechanical abrasion and then accentuated by alkali attack. The term "scuffing" is commonly used to describe the pitting, knicking, scratching, wear and general defacement of the surfaces of glassware containers through the combined forces of mechanical abrasion, chemical corrosion and weathering.

Glass derives its strength from an unblemished surface and any flaws therein decrease the strength to only a fraction of the original value. Scuffing reduces the strength of glass bottles and renders them more liable to breakage during handling and in the case of carbonated beverages, explosion following filling and crowning. As a result, a number of efforts have been made heretofore to reduce scuffing to a minimum.

One of the most successful methods of reducing scuffing is by hot end coating the glassware with a substantially colorless and transparent thin protective coating including at least one organic coating material which is applied to the glass surface while hot. In accordance with one variant of the hot end coating method, the surface of the glassware is sprayed with a dilute solution or aqueous emulsion of the organic coating material such as polyethylene and/or an alkali metal salt of a fatty acid at an elevated temperature which is below the annealing temperature to thereby deposit a tightly adherent abrasion resistant organic film. In accordance with one preferred variant, the glass surface is provided with a thin transparent, substantially colorless dual protective coating which has outstanding abrasion resistant properties. The coating immediately adjacent the glass surface is a layer of a metal oxide and the second layer is an organic coating material which is applied thereover and bonded thereto. In one of the most preferred variants, a first layer of tin, zirconium or titanium oxide is pyrolyzed onto the hot glass surface, and a dilute aqueous emulsion of polyethylene or a mixture of polyethylene and an alkali metal salt of a fatty acid is applied over the first layer and bonded thereto while the glass surface is still hot.

Hot end coated glassware is much stronger and abrasion resistant initially than uncoated glassware. However, hot end coated glassware does have one severe deficiency in that when it is cleaned repeatedly in conventional soaker-washers using highly alkaline cleaning solutions, there is a very objectionable discoloration and a marked loss of lubricity. Apparently at least the outer organic protective coating layer is altered and/or either partially or completely removed by the repeated washings and the washing solution is then free to attack the inner metal oxide layer when present. The discoloration is unsightly and not acceptable to the bottling industry from the esthetic standpoint. The loss of lubricity renders the glass surface subject to scuffing as was true of the uncoated glass surfaces of the prior art. A suitable method of effectively overcoming the foregoing deficiency of hot end coated glassware was not available prior to the present invention in spite of the great need therefor.

THE SUMMARY OF THE INVENTION

The present invention provides a novel method of washing soiled hot end coated glassware which preserves the desirable protective properties and appearance of the coating. As a result, the unsightly discoloration and loss of lubricity characteristic of repeated washings of hot end coated glassware in strongly alkaline aqueous solutions is prevented. The coating remains colorless and transparent without a serious loss of lubricity, and the glassware retains its initial high strength and pleasing appearance. The foregoing is accomplished by washing the hot end coated glassware in an aqueous caustic soda solution which also contains a soluble zinc-bearing substance dissolved therein in an amount effective to inhibit the deleterious effects of the washing solution on the outer organic coating, and ultimately upon the inner metal oxide coating when present. A novel inhibited aqueous caustic soda washing solution and an additive composition therefore are also provided which are especially useful in practicing the above method.

The detailed description of the preferred variants of the invention and the specific examples appearing hereinafter may be referred to for a more complete and comprehensive understanding of the invention.

THE DETAILED DESCRIPTION OF THE INVENTION INCLUDING CERTAIN PRESENTLY PREFERRED VARIANTS THEREOF

In accordance with the method of the invention, hot end coated glassware having a substantially colorless and transparent thin protective coating thereon including at least one organic coating material is washed in an inhibited aqueous solution containign containing soda, a soluble zinc containing compound and water. As will be described in greater detail hereinafter, improved results are usually obtained when the washing solution also contains an anionic surfactant, a nonionic surfactant, and a sequesterant. All references made hereinafter to quantities or percentages of the ingredients used in preparing the washing solution are by weight unless otherwise indicated.

The washing solution may contain from 0.3 to 6 percent of caustic soda, and preferably about 2 to 4 percent. The best results are usually achieved when the caustic soda is present in a concentration of approximately 3 percent. Caustic soda, i.e., sodium hydroxide is available commercially in large quantities and is usually the preferred alkali metal hydroxide due to its lower cost. It is understood that other alkali metal hydroxides such as potassium hydroxide may be present when desired.

The washing solution contains an inhibitor which markedly reduces the rate at which the caustic soda attacks the protective coating on the glassware. The inhibitor is a soluble zinc containing compound which is dissolved in the washing solution in an amount to provide from 0.01 to 0.3 percent, when calculated as zinc oxide, and preferably about 0.03 to 0.1 percent. The best results are often achieved when the washing solution contains the zinc compound in an amount of approximately 0.06 percent when calculated as zinc oxide.

The specific zinc-bearing substance to be added to the washing solution and/or dissolved in a strongly alkaline aqueous medium and then added thereto, is not of importance provided the substance is capable of being solubilized as a zincate. The zinc bearing substance may be metallic zinc or a suitable zinc containing compound such as, for example, zinc chloride, zinc sulfate, zinc nitrate, zinc phosphate, zinc oxide, sodium zincate, potassium zincate, and the like. Mixtures of two or more of the zinc bearing substances may be used. Zinc oxide is usually preferred and especially when in the form of a finely divided powder which dissolves rapidly. The zinc bearing substance may be added to the washing solution or other strongly alkaline aqueous medium and dissolved therein. Room temperature is often satisfactory in the presence or absence of agitation but the dissolution proceeds at a faster rate with agitation and when using an elevated temperature such as 50°–100°C. The dissolution step is continued until the zinc bearing substance is in solution.

Regardless of the initial source, the zinc is present as the alkali metal zincate, e.g., sodium zincate upon dissolution and admixing in the strongly alkaline washing solution. The amount of zinc source to be added and the amount of the zinc compound in the washing solution are calculated on a weight basis as zinc oxide, as distinguished from the initial metallic zinc or zinc compound or the solublized alkali metal zincate.

The source of the water that is used in preparing the washing solution is not of importance provided deleterious impurities are not present. For example, the water may be tap water from a municipal water supply, distilled water, deionized water, and the like. The water is present in the quantity necessary to provide the aforementioned concentrations of ingredients in the washing solution.

In addition to the above mentioned essential ingredients, for preferred results the washing solution contains an anionic surfactant, a nonionic surfactant and a sequestering agent. The anionic surfactant may be dissolved therein in an amount from 0.002 to 0.05 percent and preferably about 0.01 to 0.03 percent. The nonionic surfactant may be present in an amount from 0.001 to 0.03 percent, and preferably about 0.005 to 0.01 percent. The sequestering agent may be present in an amount from 0.008 to 0.2 percent, and preferably about 0.03 to 0.1 percent. The best results are usually obtained when the washing solution contains approximately 0.013 percent of the anionic surfactant, 0.007 percent of the nonionic surfactant, and 0.06 percent of the sequestering agent.

The anionic surfactant comprises at least one synthetic organic phosphate ester having hydrotrophic properties. A large number of such synthetic organic phosphate ester anionic surfactants are known and may be selected by one skilled in this art for use in the present invention. The phosphate esters of various hydroxylic organic compounds may be used. The alkylphenol polyglycol ether phosphates are very satisfactory and may be used advantageously. The presently preferred synthetic organic phosphate ester anionic surfactant is more particularly described in U.S. Pat. No. 3,235,627, the disclosure of which is incorporated herein by reference. A product marketed commercially by Rohm and Haas under the trademark "Triton H-66" gives exceptionally good results. In its commercial form, Triton H-66 is the potassium salt of an alkylphenol polyglycol ether phosphate which is sold as a 50 percent solids aqueous solution, and which is further characterized by a viscosity of 120 centipoises at 25°C. a specific gravity of 1.26, a pH of 8–10 in 5 percent aqueous solution, and a freezing point of −20°C. Other metal salts and ammonium salts of the foregoing class of anionic surfactants may be used and especially the sodium, potassium and ammonium salts.

Another phosphate ester anionic surfactant which may be employed is the phosphate ester of the nonionic surfactant represented by the formula:

$$R-O(A)_n-H$$

wherein R is an alcoholic residue or alkyl group having from 10 to 18 carbon atoms or mixtures thereof, A is either oxyethylene groups or a mixture of oxyethylene and oxypropylene groups in an ethylene oxide to propylene oxide weight ratio of from 0.5:1 to 6:1, and n is an integer sufficiently large to ensure that A constitutes from 40 to 85 percent of the total weight of the surfactant.

As is known in the art, when a mixture of compounds of the type used herein is employed there is generated a series of closely related homologs having varying oxyalkylene chain lengths. Thus, the values indicated above are average values. Typical of these nonionic surfactants are those disclosed and claimed in U.S. Pats. Nos. 3,340,309; 3,504,041; and Canadian Pat. No. 770,644.

The phosphate ester anionic surfactant is prepared by reacting the nonionic surfactant with polyphosphoric acid. Generally, the polyphosphoric acid is used in excess over stoichiometric requirements. The phosphate ester obtained by this reaction is, rather, a mixture of mono- and diesters corresponding to the formulae:

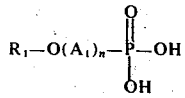

and

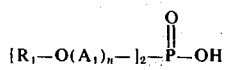

wherein $R_1$, $A_1$ and n have the meanings ascribed to R, A and n, above, and wherein the mixture comprises from 60 to 100 percent by weight of monoester and from 40 to 0 percent by weight of diester and $A_1$ constitutes from about 30 to 80 percent of the total weight of the ester.

The synthetic alkoxylated nonionic surfactants to be used preferably exhibit low foaming characteristics. Examples of alkoxylated nonionic synthetic detergents which may advantageously be employed include polyoxyalkylene adducts of hydrophobic bases. Ethylene oxide, for example, is condensed with the hydrophobic base in an amount sufficient to impart water solubility and surface active properties to the molecule being prepared. The exact amount of ethylene oxide condensed with the hydrophobic base will depend upon the chemical characteristics of the base employed and is readily apparent to those of ordinary skill in the art relating to the synthesis of oxyalkylene surfactant condensates. In general, the amount of ethylene oxide is less than 20 percent of the weight of the hydrophobic base.

Typical hydrophobic bases which can be condensed with ethylene oxide in order to prepare nonionic surface active agents include mono- and polyalkyl phenols and the compounds prepared by condensing polyoxypropylene onto a base having from about 1 to 6 carbon atoms and at least one reactive hydrogen atom. The hydrocarbon ethers such as the benzyl or lower alkyl ether of the polyoxyethylene surfactant condensates are also advantageously employed in the compositions of the invention.

Further suitable nonionic surface active agents are the polyoxyethylene esters of higher fatty acids having from about 8 to 22 carbon atoms in the acyl group. typical products are the polyoxyethylene adducts of tall oil, rosin acids, lauric, stearic and oleic acids and the like. Additional nonionic surface active agents are the polyoxyethylene condensates or higher fatty acid amines and amides having from about 8 to 22 carbon atoms in the fatty alkyl or acyl group. Illustrative products are coconut oil, fatty acid amines and amides condensed with ethylene oxide.

Other suitable polyoxyethylene nonionic surface active agents are the ethylene oxide adducts of higher aliphatic alcohols and thioalcohols having from about 8 to 22 carbon atoms in the aliphatic portion. A typical product is tridecyl alcohol condensed with ethylene oxide.

Other suitable nonionic surface active agents are cogeneric mixtures of conjugated polyoxyalkylene compounds containing in their structure at least one hydrophobic oxyalkylene chain in which the oxygen/carbon atom ratio does not exceed 0.40 and at least one hydrophilic oxyalkylene chain in which the oxygen/carbon atom ratio is greater than 0.40. In accordance with the preferred practice of this invention, the hydrophilic oxyalkylene chain is less than 20 percent of the total weight of the oxyalkylene chains.

Polymers of oxyalkylene groups obtained from propylene oxide, butylene oxide, amylene oxide, styrene oxide, mixtures of such oxyalkylene groups with each other and with minor amounts of polyoxyalkylene groups obtained from ethylene oxide, butadiene dioxide, and glycidol are illustrative of hydrophobic oxyalkylene chains having an oxygen/carbon atom ratio not exceeding 0.40. Polymers of oxyalkylene groups obtained from ethylene oxide, butadiene dioxide, glycidol, mixtures of such oxyalkylene groups with each other and with minor amounts of oxyalkylene groups obtained from propylene oxide, butylene oxide, amylene oxide and styrene oxide are illustrative of hydrophilic oxyalkylene chains having an oxygen/carbon atom ratio greater than 0.40.

Among the conjugated polyoxyalkylene compounds which may be used are those which correspond to the formula $$Y(C_3H_6O)_n(C_2H_4O)_mH$$

wherein Y is the residue of an organic compound having from about 1 to 6 carbon atoms and one reactive hydrogen atom, n has an average value of at least about 6.4 as determined by hydroxyl number and m has a value such that the oxyethylene portion constitutes up to about 20 weight percent of the molecule. These surface active agents are more particularly described in U.S. Pat. No. 2,677,700.

Other conjugated polyoxyalkylene surface active agents which are most advantageously used correspond to the formula:

$$Y[(C_3H_6O)_n(C_2H_4O)_mH]_x$$

wherein Y is the residue of an organic compound having from about 2 to 6 carbon atoms and containing x reactive hydrogen atoms in which x has a value of at least about 2, n has a value such that the molecular weight of the polyoxypropylene hydrophobic base is at least about 900 and m has a value such that the oxyethylene content of the molecule is up to about 20 weight percent. Compounds falling within the scope of the definition for Y include, for example, propylene glycol, glycerine, pentaerythritol, trimethylolpropane, ethylene diamine, and the like. As already noted, the oxypropylene chains optionally, but advantageously, contain small amounts of ethylene oxide and the oxyethylene chains also optionally, but advantageously, contain small amounts of other alkylene oxides such as propylene oxide and butylene oxide.

The polyoxypropylene-polyoxyethylene block copolymers useful as low foaming nonionic surfactants include compounds corresponding to the structural formula:

$$HO(C_2H_4O)_a(C_3H_6O)_b(C_2H_4O)_cH$$

having a molecular weight of from about 900 to 4500 and wherein a and c have values such that the ethylene oxide residua comprise from zero to about 20 percent by weight of the total molecular weight of the copolymer. Copolymers of this type are usually prepared by condensing ethylene oxide with polypropylene glycol, polypropylene glycol in turn being the condensation reaction product of propylene oxide and propylene glycol. These compositions are more particularly described in U.S. Pat. No. 2,674,619.

Other suitable nonionic surface active agents include ethoxylated and propoxylated adducts of ethylenediamine of a type generally described in U.S. Pat. No. 2,979,528 but restricted to compounds exhibiting low foaming characteristics such as nonionic surfactants corresponding to the following structural formula:

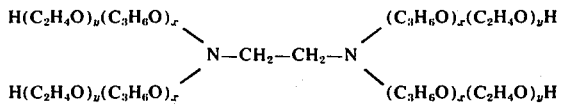

having a total molecular weight of from 900 to 7800, and wherein y is a integer having a value which insures that the ethylene oxide residua constitute a maximum of about 20 percent weight of the total molecular weight of the molecule. Compounds of this type may be prepared by the sequential addition of propylene oxide and ethylene oxide to ethylene diamine under oxyalkylation conditions.

Especially suitable alkoxylated linear aliphatic alcohols may contain 8–20 carbon atoms and preferably about 12–18 carbon atoms, and the alkylene oxide residua may comprise 5–40 percent by weight and preferably about 10–20 percent by weight of the molecule. The linear aliphatic alcohols are preferably ethoxylated and/or propoxylated under prior art alkoxylation conditions.

Additional low foaming nonionic surface active agents are disclosed in U.S. Pat. Nos. 3,425,755, 3,340,309, 3,504,041 and 3,770,701. The disclosures of low foaming nonionic surface active agents in the above mentioned United States Patents are incorporated herein by reference.

The various types of nonionic surfactants disclosed herein may be used individually or admixtures thereof may be employed. Exemplary admixtures comprise a weight ratio of the above described ethyoxylated and propoxylated adduct of ethylenediamine to one or more of the remaining nonionic surfactants ranging from about 2:1 to 1:2, and preferably about 1:1 may be employed.

The sequesterant is preferably of the type used in conditioning hard water. A wide variety of hard water conditioning sequesterants are known and may be selected by one skilled in this art for use in practicing the present invention such as ethylenediamine tetraacetic acid, nitrilotriacetic acid, the sugar acids, and the ammonium salts and metal salts thereof. Usually the sodium, potassium and ammonium salts are preferred. Other substances which may be used include the phosphates, pyrophosphates, polyphosphates, etc. The presently preferred sequestering agents are $\alpha$, $\alpha'$, $\alpha''$, -amino tris(methyl phosphonic acid), the sugar acids and/or the ammonium and metal salts thereof of which the sodium, postassium and ammonium salts are preferred. The term "sugar acid" as used herein refers to the fermentation acids as well as the aldonic and dibasic acids produced from sugars by chemical oxidation. Examples of this class of acids include lactic acid, citric acid, gluconic acid, 2-ketogluconic acid, glucoheptonic acid, tartaric acid, arabonic acid, galactinic acid, saccharic acid, mucic acid, and the like. Typical alkali metal salts of the sugar acids include sodium lactate, sodium citrate, potassium sodium tartrate, sodium arabonate, sodium gluconate, sodium galactonate, sodium 2-ketogluconate, potassium sodium saccharate, sodium mucate and sodium glucoheptonate. The above compounds and their use as sequestering agents is more particularly described by Mehltretter, et al, Industrial and Engineering Chemistry, Vol. 95, No. 12, December, 1953, pages 2782, et. seq., the disclosure of which is incorporated by reference. Sodium gluconate and/or sodium glucoheptonate are the presently preferred salts of the sugar acids.

A mixture of two or more of the above classes of sequestering agents often gives better results. The presently preferred mixture of sequestering agents has a weight ratio of (1) a sugar acid to (2) $\alpha, \alpha', \alpha''$, -amino tris-(methyl phosphonic acid) and/or the sodium, potassium or ammonium salts of (1) and (2) from about 15:1 to 25:1, and for best results about 18:1 to 22:1.

The novel washing solution and additive composition for use in preparing and maintaining the same have a synergistic combination of ingredients which contribute both to the low foaming characteristics and enhanced inhibition. Thus, while very good results are achieved by washing the glassware in a solution containing only caustic soda, the zinc containing compound and water much better results are obtained when the washing solution has the following composition:

| Ingredient | Weight % Broad Range | Preferred Range | Optimum Amount |
|---|---|---|---|
| Caustic Soda | 0.3–6 | 2–4 | 3 |
| Zinc Compound (Zinc Oxide) | 0.01–0.3 | 0.03–0.1 | 0.06 |
| Anionic Surfactant | 0.002–0.05 | 0.01–0.03 | 0.013 |
| Nonionic Surfactant | 0.001–0.03 | 0.005–0.01 | 0.007 |
| Sequesterant | 0.008–0.2 | 0.03–0.1 | 0.06 |
| Water | remainder | remainder | remainder |

The novel additive of the invention has the following composition:

| Ingredient | Weight % Broad Range | Preferred Range | Optimum Amount |
|---|---|---|---|
| Caustic Soda | 2.5–35 | 15–20 | 18 |
| Zinc Compound (Zinc Oxide) | 0.5–7 | 2–5 | 3.5 |
| Anionic Surfactant | 0.2–2.7 | 0.5–1 | 0.8 |
| Nonionic Surfactant | 0.06–0.8 | 0.2–0.6 | 0.4 |
| Sequesterant | 1–14 | 2–5 | 3.6 |

-continued

| Ingredient | Weight % Broad Range | Preferred Range | Optimum Amount |
|---|---|---|---|
| Water | remainder | remainder | remainder |

It is understood that the zinc containing compound in the above washing solution and additive composition is calculated as zinc oxide as previously mentioned. Also, the various ingredients are as previously mentioned in discussing the method of the invention.

The washing solution and additive composition may be prepared by merely admixing the ingredients together in the prescribed amounts. The zinc bearing substance may be dissolved as discussed hereinbefore and then admixed with the remaining ingredients. Ambient temperature conditions are usually satisfactory, but elevated temperature may be used such as 50°–100°C. In general, no special handling procedures are necessary.

The additive composition may be used when preparing the washing solution initially and/or it may be used for making additions to maintain the concentrations of ingredients at the desired levels. When preparing the washing solution initially, the additive composition is admixed with water in an amount to provide the desired amount of the zinc containing compound in the final solution and the caustic soda level is adjusted as necessary by adding concentrated aqueous caustic soda or caustic soda in flake form. The additive composition is formulated to provide the proper ratio of all ingredients in the washing solution with the possible exception of the caustic soda. Thus, increments of the additive composition and additional caustic soda may be added to an existing washing solution in the quantities necessary to maintain the desired concentrations of ingredients.

The washing solution may be used for washing soiled hot end coated glassware in accordance with prior art techniques. As a general rule, it is only necessary to substitute the washing solution of the present invention for a prior art caustic soda washing solution. In instances where the hot end coated glassware is in the form of returnable beverage bottles, then a mechanical washing machine of the soaker-washer type or the hydraulic type may be used. A soaker-washer machine known in the art as Meyer Dumore Model No. 524PT is very satisfactory and a typical prior art operating cycle therefor may be used. The operating cycle usually includes passing the bottles successively through a series of five tanks which are filled with cleaning or rinsing solutions. The returned soiled bottles usually are washed with warm water followed by soaking at approximately 130°–140°F in a washing solution containing 3–3.5 percent of caustic soda, followed by soaking at approximately 160°–175°F in a washing solution containing about 2.5–3 percent of caustic soda, followed by a further soaking cycle at about 145°–155°F in a solution containing 1–2 percent of caustic soda. The soaking cycles are usually followed by aqueous rinsing cycles at lower temperatures, such as a temperature of 80°–100°F. in a first rinse tank, followed by a temperature of 60°–70°F. in a second rinse tank. Thereafter the bottles may be brushed internally and externally to remove any adherent deposits followed by one or more internal and external fresh water rinses. The cleaned and rinsed bottles may be given internal and external chlorination rinses for the purpose of killing any microbes which may be present.

It is understood that the number and sequence of the cleaning and rinsing steps is dependent to some extent upon the nature of the foreign substances on the soiled bottles and the extent of the soiled areas. A practical range of temperature for the soaking step is about 120°–180°F. and preferably about 160°–170°F. Usually lower temperatures require longer soaking periods, whereas higher temperatures require shorter soaking periods. As a general rule, the period of exposure to the washing solution is about 2–10 minutes in each soaking step, and preferably about 4–5 minutes.

The hot end coated glassware to be washed in accordance with the method of the invention may be in the form of glasses, tumblers, bottles, cups, jars, plates, and the like. The method is especially effective in instances where the glassware is of the returnable type and therefore subjected to a plurality of washings in a highly alkaline caustic soda solution during its normal life span. Returnable bottles of the types employed in the milk, soft drink and brewing industries are the most important from the commercial standpoint, but the invention also has utility in other fields. In instances where the hot end coated glassware is washed a number of times in the caustic soda washing solutions of the prior art, then the outer protective organic coating is partially or completely removed and the caustic soda solution is free to attack the inner metal oxide coating when present.

An unsightly discoloration develops which renders the glassware unacceptable from the esthetic standpoint and especially when used as a container for food and beverages. Additionally, once the protective coating is removed the abrasion resistance drops markedly and the glassware is subject to scuffing and loss of strength as was characteristic of the prior art uncoated glassware. The method of the present invention increases the effective life of the protective coating by at least five fold and often even longer, and thus the useful life of the glassware is increased by an equal amount.

The preparation of hot end coated glassware is described in a number of United States Patents, including the following which are incorporated herein by reference:

| | | |
|---|---|---|
| 2,995,533 | 3,352,708 | 3,407,085 |
| 3,352,707 | 3,368,915 | 3,441,399 |
| | | 3,743,491 |

In general, the above patents disclose methods of providing glassware with a protective coating shortly after the molten glass has been solidified into the shape of the article being manufactured. The surface of the glass is still hot, and the heat content thereof is utilized in the protective coating step to deposit the protective film and cause the same to adhere tightly to the glass surface. In one variant, only an organic protective coating is applied to the glass surface. In a further variant, a dual protective coating is applied which comprises an inner metal oxide layer and an outer organic layer.

The single protective coating variant is illustrated in U.S. Pat. No. 2,995,533. In accordance with the method of this patent, the abrasion resistance and strength of the glassware is increased by spraying an aqueous emulsion containing polyethylene and an alkali metal fatty acid salt on the hot glass surface. At the time of applying the aqueous emulsion, the glassware surface is at a sufficiently elevated temperature to result in the immediate evaporation of the water component of the emulsion and to obtain a tight adherence of the polyethylene particles to the glass surface. A temperature of approximately 400°F. is satisfactory. It is preferred that the aqueous emulsion be sprayed onto the surface of the glassware in controlled quantities to allow rapid evaporation of the water content and cause an extremely tight adherence of the polyethylene particles to the glass surface in the form of a thin invisible protective organic film.

In the presently preferred commercial practice, the glassware surface is provided with a thin transparent, substantially colorless dual protective coating. The inner protective coating layer is a metal oxide layer which is formed by pyrolyzing a heat decomposable organic compound of the desired metal on the hot glass surface. A wide variety of metal oxides may be applied, such as tin, zirconium, titanium, aluminum, vanadium, germanium, iron, cobalt, nickel, zinc, lead, and the like. Usually an oxide of tin, zirconium or titanium is preferred. The glass surface is sufficiently hot at the time of applying the metal bearing compound to cause the immediate decomposition thereof and the deposition of an oxide of the metal which adheres tightly to the glass surface. Thereafter, a solution or aqueous emulsion of an organic coating material is applied while the glass surface is still hot following the general technique previously described for the single protective coating variant. Examples of organic coating materials which may be applied include olefin polymers such as polyethylene and polypropylene, polyamides, polyesters, polyvinyl alcohol, copolymers of ethylene and ethylenically unsaturated carboxylic acids, polybutadiene, copolymers of vinylchloride and vinyl acetate, polyurethanes, organopolysiloxanes and carnauba wax. The resulting outer layer of an organic protective coating is applied over the metal oxide layer, and it adheres tightly and is bonded thereto. The dual protective coating imparts excellent abrasion resistance and is much more durable and lasting, and especially when the metal oxide is tin oxide and the organic coating comprises polyethylene. Examples of the dual coating variant are disclosed in U.S. Pat. Nos. 3,368,915, 3,407,085, and 3,743,491.

Protective coatings on glassware of the types disclosed in the aforementioned patents are generally known and referred to in this art as "hot end coatings", and the glassware produced by such coating processes is commonly referred to as "hot end coated glassware." These art accepted terms are therefore adopted and used herein in the specification and claims.

The foregoing detailed description and the following specific examples are for purposes of illustration only, and are not limiting to the spirit or scope of the appended claims. All references to quantities or percentages appearing in the specification and claims are by weight unless otherwise indicated.

EXAMPLE I

This example illustrates the washing of hot end coated glassware in accordance with the method of the invention.

Hot end coated returnable soft drink bottles were washed in this example. The bottles were coated with a dual protective coating including a tin oxide undercoating and a polyethylene organic coating applied thereover and bonded thereto.

The bottles were washed in a Meyer Dumore Model No. 524 PT Soaker-Washer which had five tanks arranged in series. The first three of the five tanks were filled with washing solutions having varying concentrations of ingredients and the last two tanks were aqueous rinsing tanks. The general washing technique that was employed was in accordance with prior art practice for a soaker-washer of this type with the exception of using the washing solution of the present invention.

The concentrations of ingredients in the five soaker-washer tanks and the operating temperature are given below:

| Ingredients (Wt%) Operating Temperatures (°F) | Soaker-Washer Tank No. 1 | 2 | 3 | 4 | 5 |
|---|---|---|---|---|---|
| Caustic Soda | 3.3 | 2.8 | 1.5 | 0.3 | trace |
| Zinc Compound (Zinc Oxide) | 0.06 | 0.06 | 0.05 | 0.04 | 0.01 |
| Anionic Surfactant[1] | 0.013 | 0.013 | 0.01 | 0.006 | 0.002 |
| Nonionic Surfactant[2] | 0.007 | 0.007 | 0.006 | 0.004 | 0.001 |
| Sequestering Agent[3] | 0.06 | 0.06 | 0.05 | 0.03 | 0.01 |
| Water | remainder | remainder | remainder | remainder | remainder |
| Operating temperature | 130–136 | 160–172 | 144–152 | 80–100 | 60–70 |

[1]The anionic surfactant was Triton H-66, which is an alkylphenol polyglycol ether phosphate in potassium salt form having a viscosity of 120 centipoises at 25°C., a specific gravity of 1.26, a pH of 8–10 in 5% aqueous solution and a freezing point of −20°C.

[2]The nonionic surfactant was an ethoxylated adduct of the condensation product of ethylene diamine and propylene oxide having an average molecular weight of from 2750 to 3350 and containing about 10% by weight of ethylene oxide residua.

[3]The sequestering agent was a mixture of (a) sodium glucoheptonate and (b) α, α', α'',-amino tris-(methyl phosphonic acid) in a weight ratio of (a) to (b) of 20:1.

The overall time required for the bottles to make one trip through the soaker-washer was 20–25 minutes. Thus, the bottle residence time in each of the five tanks was approximately 4–5 minutes.

The test bottles were recycled through the soaker-washer for a total of 25 trips. Representative samples of the test bottles were retained after each five trips through the washer up to and including the 25th trip., i.e., for the fifth, tenth, fifteenth, twentieth and 25th trips. After the 25th trip, a sample from each group of the representative samples of the bottles was placed in the first soaker-washer tank and allowed to remain therein for one half-hour with the machine stopped. This static soak was for the purpose of observing the effects of prolonged exposure to the highly alkaline caustic soda solution of Tank No. 1.

Upon testing and evaluating the various sample bottles prepared by the above procedure, the protective films thereon were found to be intact. The bottles still exhibited good lubricity characteristics and there was no indication of discoloration or loss of strength. Thus, the method of the invention is capable of prolonging the effective life of the protective coating over at least twenty-five recyclings.

EXAMPLE II

This example illustrates the detrimental effects of washing hot end coated soft drink bottles in caustic soda solutions in accordance with prior art practice.

The general procedure of Example I was repeated in this example with the exception of omitting the zinc compound, the anionic surfactant, the nonionic surfactant and the sequestering agent from the washing solution. Thus, the washing solution contained only caustic soda and water in the concentrations noted therefor in Example I.

The bottles were discolored after completing five trips through the soaker-washer. Upon further examination and testing, it was found that the protective coating was altered and/or removed and was no longer capable of protecting the bottle surfaces. Scuffing and loss of strength resulted therefrom in addition to discoloration after the equivalent of only five recyclings. Inasmuch as the average life of returnable beverage bottles is approximately 15 recyclings, it is apparent that the useful life of the hot end coated bottles is shortened due to washing in the uninhibited caustic soda cleaning solutions of the prior art.

We claim:

1. In a method of recycling returnable hot end coated glass containers wherein the glass containers are cycled a plurality of cycles over the normal useful life thereof, the glass containers in said cycles being filled with a product and thereafter emptied and the resultant soiled empty containers being returned for washing and refilling with a product, the said soiled returned glass containers being washed in said cycles in an alkaline aqueous solution of alkali metal hydroxide prior to refilling, the said hot end coated glass containers having a thin protective coating thereon including a coating of an organic hot end coating material applied to the glass containers while hot, the resultant hot end coating initially being substantially free of objectionable color and imparting abrasion resistance to the glass containers, the initial hot end coating being altered by the repeated washings in said cycles in the said aqueous solution of alkali metal hydroxide whereby the glass containers exhibit loss of abrasion resistance or an objectionable discoloration appears, the improvement in combination therewith which consists essentially of prolonging the useful life of the said protective hot end coating including the said coating of the organic hot end coating material by washing the said soiled hot end coated glass containers in an inhibited aqueous caustic soda cleaning solution consisting essentially of on a weight basis from 0.3 to 6.0 percent of caustic soda, from 0.01 to 0.3 percent of a soluble zinc containing compound when calculated as zinc oxide, and the remainder water.

2. The method of claim 1 wherein the said soiled hot end coated glass containers are washed in a caustic soda cleaning solution containing from 2 to 4 percent of caustic soda, from 0.03 to 0.1 percent of the zinc containing compound when calculated as zinc oxide, and the remainder water.

3. The method of claim 1 wherein the said caustic soda cleaning solution also contains from 0.002 to 0.05 percent of at least one synthetic organic phosphate ester anionic surfactant, from 0.001 to 0.03 percent of at least one low foaming synthetic alkoxylated nonionic surfactant and from 0.008 to 0.2 percent of at least one hard water conditioning sequesterant.

4. The method of claim 3 wherein the said soiled hot end coated glass containers are washed in a caustic soda cleaning solution containing from 2 to 4 percent of caustic soda, from 0.03 to 0.1 percent of the zinc containing compound when calculated as zinc oxide, from 0.01 to 0.03 percent of the said anionic surfactant, from 0.005 to 0.01 percent of the said nonionic surfactant, from 0.03 to 0.1 percent of the said sequesterant, and the remainder water.

5. The method of claim 3 wherein the said anionic surfactant is selected from the group consisting of alkylphenol polyglycol ether phosphates and the alkali metal and ammonium salts thereof.

6. The method of claim 5 wherein the said sequesterant is a mixture of (1) at least one sequestering agent selected from the group consisting of sugar acids and the alkali metal and ammonium salts thereof, and (2) at least one sequestering agent selected from the group consisting of $\alpha,\alpha',\alpha''$-amino tris-(methyl phosphonic acid) and the alkali metal and ammonium salts thereof, the sequesterant containing a ratio of sequestering agent (1) to sequestering agent (2) from about 15:1 to 25:1, and the said nonionic surfactant is a polyoxyethylenepolyoxypropylene adduct of ethylenediamine corresponding to the structural formula:

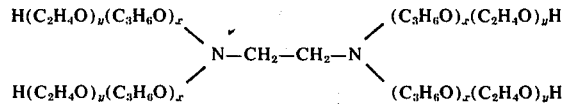

wherein y is an integer of a numerical value to insure that the ethylene oxide residua constitute a maximum of about 20 percent by weight of the total weight of the molecule, the molecular weight of the molecule being about 900 to 7800.

7. The method of claim 6 wherein the caustic soda is present in an amount of about 3 percent, the zinc containing compound is present in an amount of about 0.06 percent when calculated as zinc oxide, the said anionic surfactant is present in an amount of about 0.013 percent, the said nonionic surfactant is present in an amount of about 0.007 percent, the said sequesterant is present in an amount of about 0.06 percent, and the remainder is water.

8. The method of claim 3 wherein the said sequesterant is a mixture of (1) at least one sequestering agent selected from the group consisting of sugar acids and the alkali metal and ammonium salts thereof, and (2) at least one sequestering agent selected from the group consisting of $\alpha$, $\alpha'$, $\alpha''$-amino tris-(methyl phosphonic acid) and the alkali metal and ammonium salts thereof, the sequesterant containing a ratio of sequestering agent (1) to sequestering agent (2) from about 15:1 to 25:1.

9. The method of claim 3 wherein the said nonionic surfactant is a polyoxyethylene-polyoxypropylene adduct of ethylenediamine corresponding to the structural formula

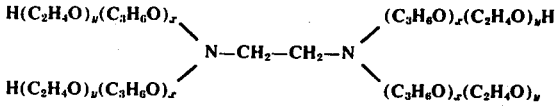

wherein y is an integer of a numerical value to insure that the ethylene oxide residua constitute a maximum of about 20 percent by weight of the total weight of the molecule, the molecular weight of the molecule being about 900 to 7800.

* * * * *